US008720157B1

(12) United States Patent
Ross et al.

(10) Patent No.: US 8,720,157 B1
(45) Date of Patent: May 13, 2014

(54) RAIL GAUGE LEVELING TIE

(75) Inventors: George H. Ross, Delano, MN (US); Jacob E. Corder, Excelsior, MN (US)

(73) Assignee: Astro Engineering & Manufacturing, Inc., Hanover, MN (US)

( * ) Notice: Subject to any disclaimer, the term of this patent is extended or adjusted under 35 U.S.C. 154(b) by 51 days.

(21) Appl. No.: 13/484,341

(22) Filed: May 31, 2012

Related U.S. Application Data

(60) Provisional application No. 61/491,399, filed on May 31, 2011.

(51) Int. Cl.
*E04G 1/22* (2006.01)

(52) U.S. Cl.
USPC ..... 52/741.11; 52/126.1; 52/126.7

(58) Field of Classification Search
USPC ..... 52/126.1–126.7, 741.11; 238/2, 3, 7–9, 238/281, 282, 310
See application file for complete search history.

(56) References Cited

U.S. PATENT DOCUMENTS

| | | | | |
|---|---|---|---|---|
| 1,279,723 | A * | 9/1918 | Liebmann | 238/282 |
| 1,279,725 | A * | 9/1918 | Liebmann | 238/282 |
| 1,279,726 | A * | 9/1918 | Liebmann | 238/282 |
| 1,279,727 | A * | 9/1918 | Liebmann | 238/282 |
| 1,279,728 | A * | 9/1918 | Liebmann | 238/282 |
| 3,361,351 | A | 1/1968 | Moses et al. | |
| 3,831,842 | A * | 8/1974 | Tamura | 238/349 |
| 5,150,835 | A * | 9/1992 | Yamamoto | 238/50 |
| 5,285,964 | A * | 2/1994 | Vanotti | 238/7 |
| 5,653,388 | A * | 8/1997 | Pietschmann et al. | 238/7 |
| 6,237,856 | B1 * | 5/2001 | Bachmann et al. | 238/7 |
| 7,500,617 | B2 | 3/2009 | Wirtz et al. | |
| 8,276,722 | B2 * | 10/2012 | Klotz | 191/32 |

FOREIGN PATENT DOCUMENTS

EP 0894898 A1 2/1999

OTHER PUBLICATIONS

"Transit Products Catalog" L B Foster Company, 2008.
Metropolitan Council, CCLRT—Central Corridor Light Rail Transit, Contract No. 09P211.8454, Mar. 31, 2010, pp. 3-5.

* cited by examiner

*Primary Examiner* — Mark Wendell
(74) *Attorney, Agent, or Firm* — Sherrill Law Offices, PLLC

(57) ABSTRACT

An assembly for a levelable rail gauge leveling tie and associated methods of preparing a railway bed for the laying of a railway track and laying railroad track employing the assembly. The assembly includes a longitudinally elongated U-shaped rail gauge leveling tie, and first and second leveling studs. The leveling tie has first and second transversely extending orifices proximate the longitudinal ends. The leveling studs are operable for threaded engagement within a corresponding orifice through the leveling tie whereby rotation of a leveling stud within the corresponding orifice effects a change in the transverse distance between the distal end of the rotated leveling stud and the central portion of the leveling tie.

16 Claims, 14 Drawing Sheets

RAIL GAUGE LEVELING TIE

This application claims the benefit of U.S. Provisional Application No. 61/491,399, filed May 31, 2011.

BACKGROUND

Construction of track for rapid transit systems, such as light rail, involves the step of temporarily supporting properly leveled and positioned ties or sleepers within an excavated railway bed, followed by permanent fixation of the properly positioned ties within concrete cast into the excavated railway bed.

Achieving the necessary and desired temporary positioning and leveling of the ties within the excavated railway bed is difficult and time consuming.

Hence, a need exists for process and device capable of quickly, easily and reliably providing a properly positioned and leveled tie within an excavated railway bed prior to and during the permanent fixation of the tie within concrete.

SUMMARY OF THE INVENTION

A first aspect of the invention is an assembly for a levelable rail gauge leveling tie. A first embodiment of the assembly includes a longitudinally elongated rail gauge leveling tie, and first and second leveling studs. The leveling tie has (i) a longitudinally elongated central portion defining longitudinally spaced first and second ends, laterally spaced first and second sides, and transversely spaced upper and lower surfaces with the lower surface spaced in a first transverse direction from the upper surface, (ii) first and second flanges extending in the first transverse direction from the first and second sides of the central portion, respectively, and (iii) first and second transversely extending orifices through the central portion of the leveling tie proximate the first and second ends of the leveling tie, respectively. The first and second leveling studs each have proximal and distal ends, and are operable for threaded engagement within a corresponding orifice through the central portion of the leveling tie whereby rotation of a leveling stud within the corresponding orifice effects a change in the transverse distance between the distal end of the rotated leveling stud and the central portion of the leveling tie.

A second embodiment of the assembly further includes first and second electrically insulating riser plates and corresponding placement holes for the riser plates within the leveling tie. The placement holes includes a first pair of longitudinally offset transversely extending holes through the central portion of the leveling tie proximate the first end of the leveling tie, and a second pair of longitudinally offset transversely extending holes through the central portion of the leveling tie proximate the second end of the leveling tie. The first and second electrically insulating riser plates each having a pair of transversely extending openings with each opening surrounded by a transversely extending circumferential collar with the collars on each riser plate configured and arranged to snuggly fit within a corresponding pair of holes through the central portion of the leveling tie for aligning the riser plate upon the leveling tie.

A third embodiment of the assembly still further includes first and second strike plates each configured and arranged to rest upon a horizontal surface and capture the distal end of a corresponding vertically extending leveling stud so as to restrict horizontal movement of the captured distal end of the leveling stud.

A fourth embodiment of the assembly further includes first and second pairs of rail clips, each configured and arranged for threadable engagement within one of the holes through the central portion of the leveling tie for securing a corresponding riser plate and rail to the leveling tie with the riser plate electrically insulating the rail from the leveling tie.

A second aspect of the invention is a method of preparing a railway bed for the laying of railway track. A first embodiment of the preparation aspect of the invention includes the steps of (a) obtaining an assembly in accordance with the first embodiment of the assembly aspect of the invention, (b) threading the first leveling stud within the first orifice and threading the second leveling stud within the second orifice to form a studded leveling tie, (c) placing the studded leveling tie within an excavated railway right of way with the distal end of the leveling studs supported upon ballast at the bottom of the excavated railway right of way, (d) rotating the threaded leveling studs until the leveling tie is at a desired vertical height and at a desired angle along the lateral length of the leveling tie to form a leveled leveling tie, and (e) casting a castable material within the excavated railway right of way to fixate the leveled leveling tie.

A second embodiment of the preparation aspect of the invention includes the steps of (a) obtaining an assembly in accordance with the third embodiment of the assembly aspect of the invention, (b) resting the first and second strike plates upon ballast in an excavated railway right of way, (c) threading the first leveling stud within the first orifice and threading the second leveling stud within the second orifice to form a studded leveling tie, (d) placing the studded leveling tie within the excavated railway right of way with the distal end of the first leveling stud supported upon and captured by the first strike plate and the distal end of the second leveling stud supported upon and captured by the second strike plate, (e) rotating the threaded leveling studs until the leveling tie is at a desired vertical height and at a desired angle along the lateral length of the leveling tie to form a leveled leveling tie, and (f) casting a castable material within the excavated railway right of way to fixate the leveled leveling tie.

A third aspect of the invention is a method of constructing railway track. One embodiment of the construction aspect of the invention includes the steps of (a) obtaining an assembly in accordance with the fourth embodiment of the assembly aspect of the invention, (b) threading the first leveling stud within the first orifice and threading the second leveling stud within the second orifice to form a studded leveling tie, (c) placing the studded leveling tie within an excavated railway right of way with the distal end of the leveling studs supported upon ballast at the bottom of the excavated railway right of way, (d) rotating the threaded leveling studs until the leveling tie is at a desired vertical height and at a desired angle along the lateral length of the leveling tie to form a leveled leveling tie, (e) casting a castable material within the excavated railway right of way to fixate the leveled leveling tie, (f) attaching a first rail to the fixated leveling tie atop a first electrically insulating riser plate aligned upon the leveling tie with the first pair of rail clips, and (g) attaching a second rail to the fixated leveling tie atop a second electrically insulating riser plate aligned upon the leveling tie with the second pair of rail clips.

DETAILED DESCRIPTION OF A PREFERRED EMBODIMENT

Nomenclature

10 Rail System

20 Rail Gauge Leveling Tie

Figure 1A:
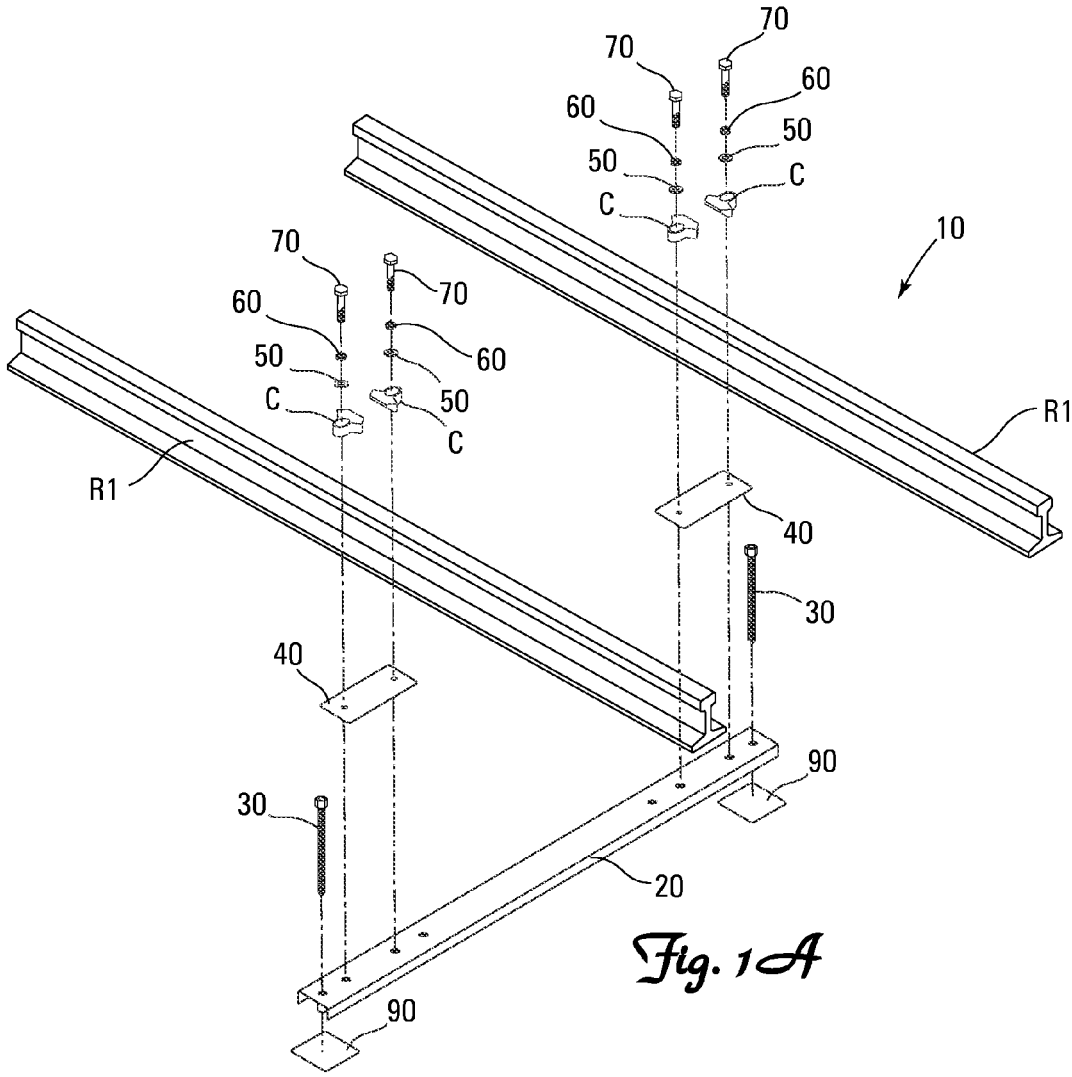
FIG. 1A is an exploded perspective view of a rail system employing one embodiment of the present invention configured to carry single rails.

20*a* Upper Surface of Central Portion of Rail Gauge Leveling Tie

20*b* Lower Surface or Underside of Central Portion of Rail Gauge Leveling Tie

20*c* First Longitudinally Extending Flange on Rail Gauge Leveling Tie

20*d* Second Longitudinally Extending Flange on Rail Gauge Leveling Tie

20*e* First End of Rail Gauge Leveling Tie

20*f* Second End of Rail Gauge Leveling Tie

21 Stiffening Plates (Collective)

$\mathbf{21}_1$ First Stiffening Plate $\mathbf{21}_2$ Second Stiffening Plate

25 Nuts Attached to Underside of Rail Gauge Leveling Tie and Aligned with Orifices Through the Tie

28 Orifice Through Rail Gauge Leveling Tie for Accommodating Passage of Leveling Stud (Leveling Orifice)

29 Hole Through Rail Gauge Leveling Tie for Accommodating Passage of Rail Clip Fastening Bolt (Fastening Hole)

30 Leveling Stud

30*d* Distal End of Leveling Stud

30*p* Proximal End of Leveling Stud

40 Electrically Insulating Riser Plate

40*a* Top of Riser Plate

40*b* Bottom of Riser Plate

40*c* First Side of Riser Plate

40*d* Second Side of Riser Plate

40*e* Outside End of Riser Plate

40*f* Inside End of Riser Plate

41 Electrically Insulating Inclined Riser Plate for Single Rail

42 Electrically Insulating Inclined Riser Plate for Double Rail

43 Circumferential Collars on Riser Plate

44 Standoff for Guide Angle

45 Electrically Insulating Plate for Guide Angle

49 Opening for Accommodating Passage of Rail Clip Fastening Bolt (Fastening Opening)

50 Round Washer

60 Lock Washer

70 Rail Clip Fastening Bolt

80 Guard Angle Fastening Bolt

90 Strike Plate

99 Centering Dimple or Orifice in Strike Plate x Longitudinal Axis of Rail Tie y Lateral Axis of Rail Tie z Transverse Axis of Rail Tie $z_1$ First Transverse Direction C Rail Clip GA Guard Angle R Rail $R_1$ Single Rail $R_2$ Double Rail Construction Referring to FIGS. 1A, 1B, 2A, 2B, 3A and 3B, a first aspect of the invention is a rail system assembly 10 for a levelable rail gauge leveling tie 20. The assembly includes a longitudinally x elongated rail gauge leveling tie 20, and first and second leveling studs 30.

Referring to FIGS. 5A, 5B, 5C, 6A, 6B, 6C and 6D, the leveling tie 20 has a longitudinally x elongated central portion (unnumbered) and first 20*c* and second 20*d* flanges extending in a first transverse direction $z_1$ from the first and second sides (unnumbered) of the central portion (unnumbered) respectively. The flanges 20*c* and 20*d* preferably extend along the entire longitudinal x length of the central portion (unnumbered) of the leveling tie 20. The central portion (unnumbered) of the leveling tie 20 defines longitudinally x spaced first 20*e* and second 20*f* ends, laterally y spaced first and second sides (unnumbered), and transversely z spaced upper 20*a* and lower 20*b* surfaces. The lower surface 20*b* is spaced in a first transverse direction $z_i$ from the upper surface 20*a*. A leveling orifice 28 extends transversely z through the central portion (unnumbered) of the leveling tie 20 proximate each end 20*e* and 20*f* of the leveling tie 20. A third transversely z extending leveling orifice 28 may be provided through the central portion (unnumbered) of the leveling tie 20 intermediate the ends 20*e* and 20*f* of the leveling tie 20.

Figure 1B:
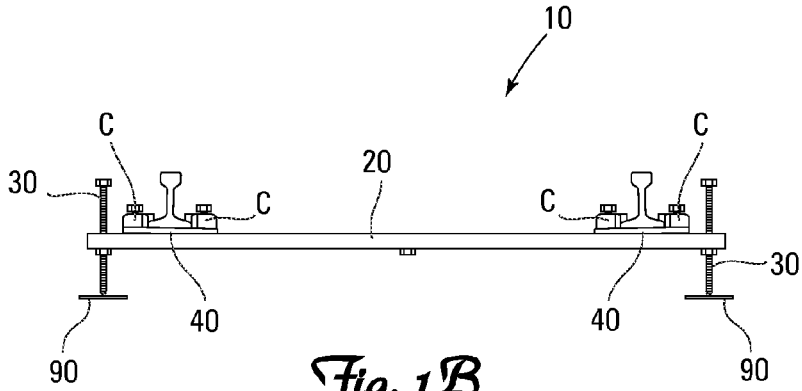
FIG. 1B is an assembled end view of the rail system depicted in FIG. 1A.
Figure 2A:
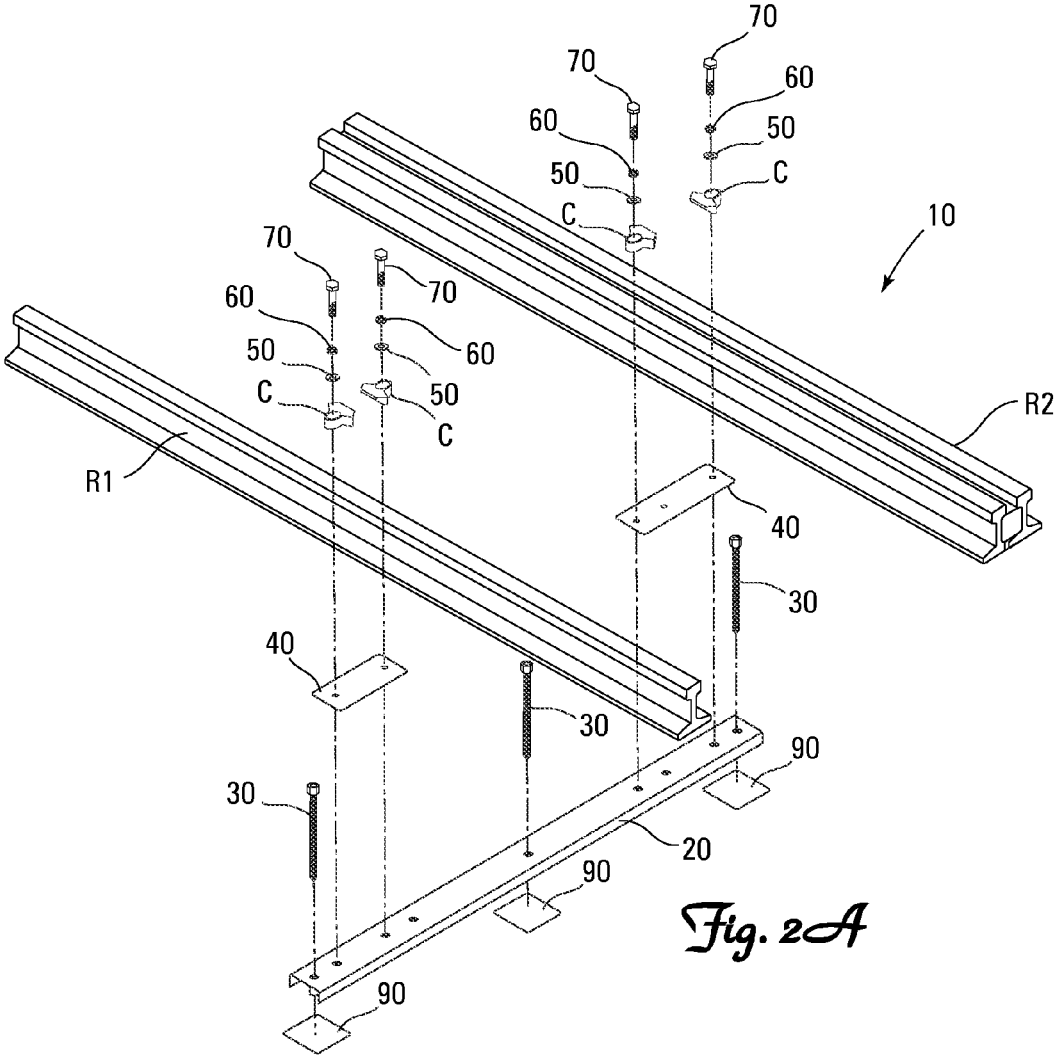
FIG. 2A is an exploded perspective view of a rail system employing one embodiment of the present invention configured to carry a single rail and a double rail.
Figure 2B:
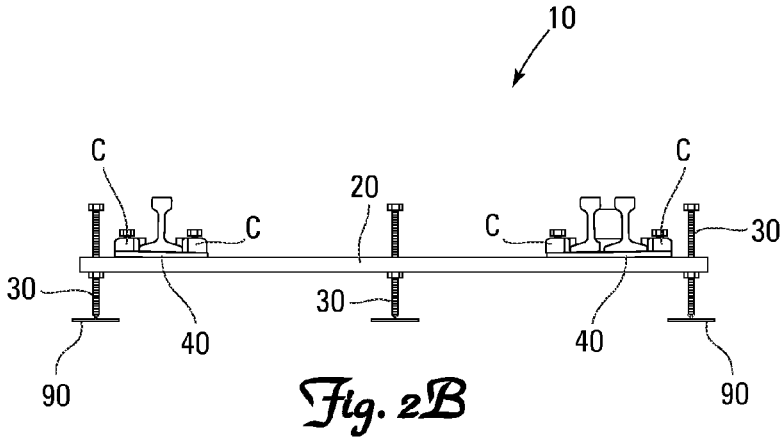
FIG. 2B is an assembled end view of the rail system depicted in FIG. 2A.
Figure 7A:
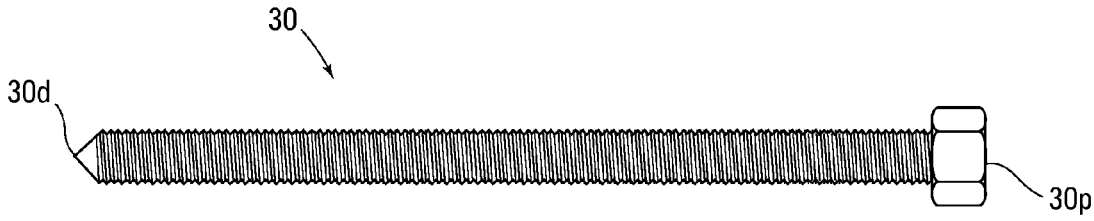
FIG. 7A is a side view of one of the leveling studs depicted in FIGS. 1A, 1B, 2A, 2B, 3A and 3B.
Figure 7B:
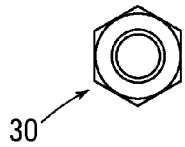
FIG. 7B is a plan view of the leveling stud depicted in FIG. 7A.
Figure 8A:
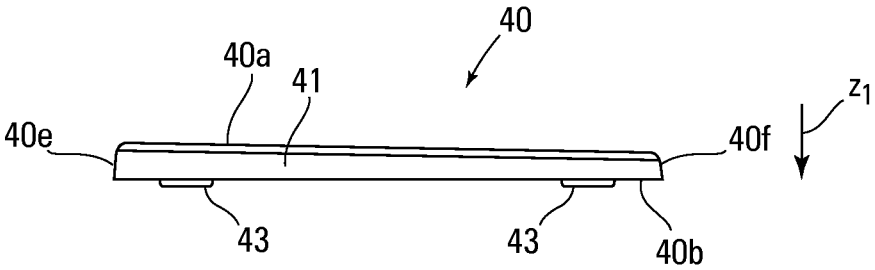
FIG. 8A is a side view of the single rail electrically insulating riser plate depicted in FIGS. 1A, 1B, 2A, 2B, 3A and 3B.
Figure 8B:
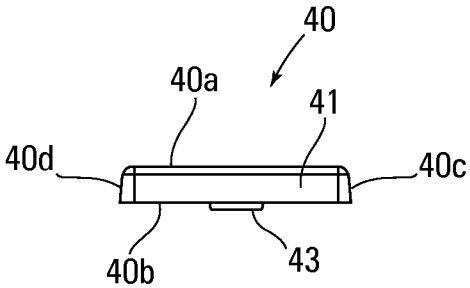
FIG. 8B is an end view of the single rail electrically insulating riser plate depicted in FIG. 8A.
Figure 8C:
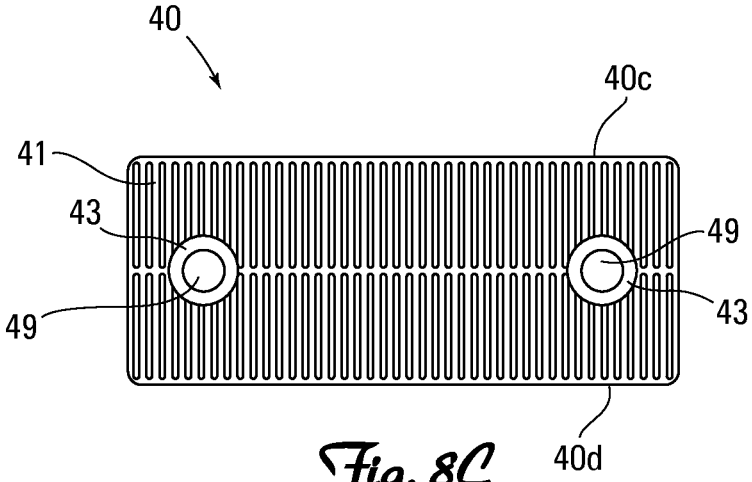
FIG. 8C is a bottom view of the single rail electrically insulating riser plate depicted in FIG. 8A.
Figure 9A:
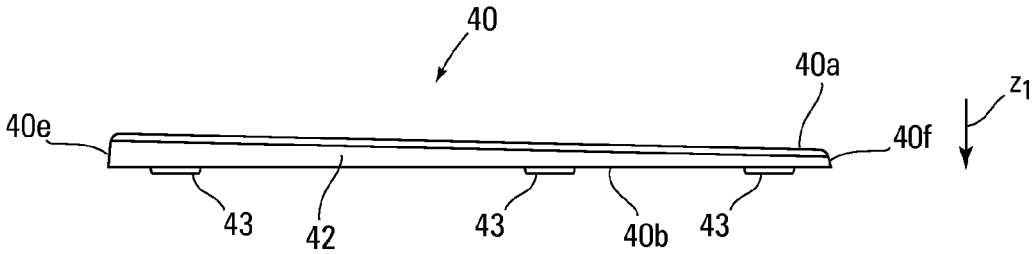
FIG. 9A is a side view of the double rail electrically insulating riser plate depicted in FIGS. 2A and 2B.
Figure 9B:
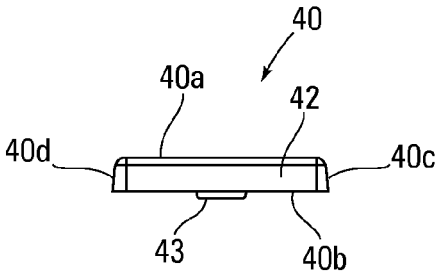
FIG. 9B is an end view of the double rail electrically insulating riser plate depicted in FIG. 9A.
Figure 9C:
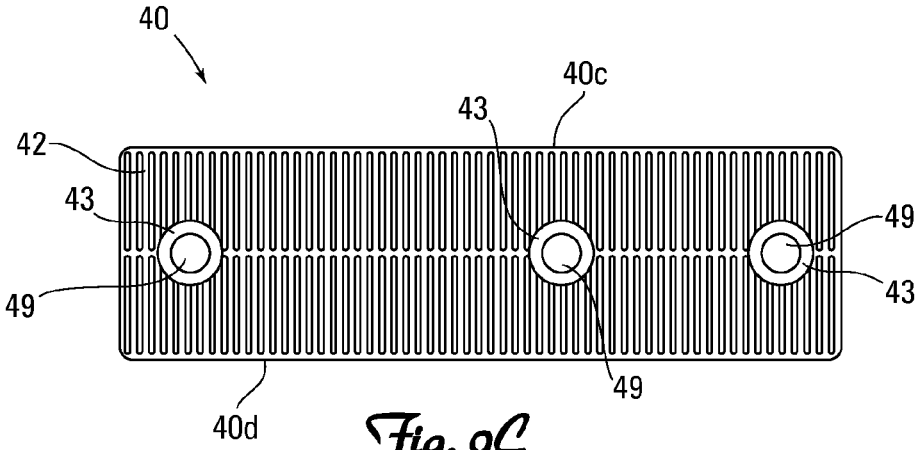
FIG. 9C is a bottom view of the double rail electrically insulating riser plate depicted in FIG. 9A.
Figure 10A:
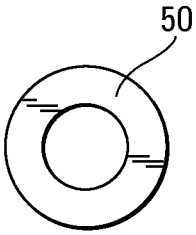
FIG. 10A is a plan view of one of the round washers depicted in FIGS. 1A, 1B, 2A, 2B, 3A and 3B.
Figure 10B:
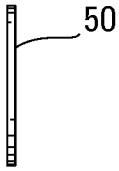
FIG. 10B is a side view of the round washer depicted in FIG. 10A.
Figure 11A:
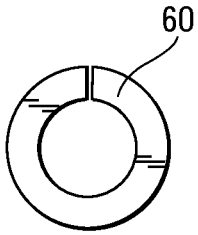
FIG. 11A is a plan view of one of the lock washers depicted in FIGS. 1A, 1B, 2A, 2B, 3A and 3B.
Figure 11B:
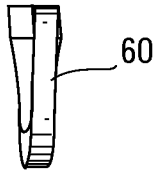
FIG. 11B is a side view of the lock washer depicted in FIG. 11A.
Figure 12B:
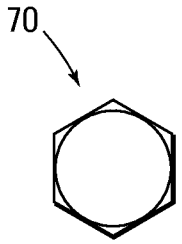
FIG. 12B is a plan view of the rail clip fastening bolt depicted in FIG. 12A.
Figure 12A:
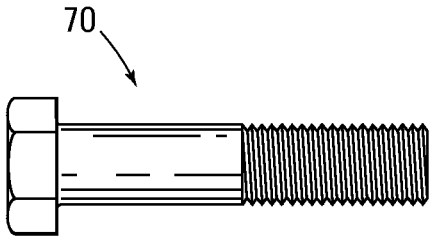
FIG. 12A is a side view of one of the rail clip fastening bolts depicted in FIGS. 1A, 1B, 2A, 2B, 3A and 3B.
Figure 13A:
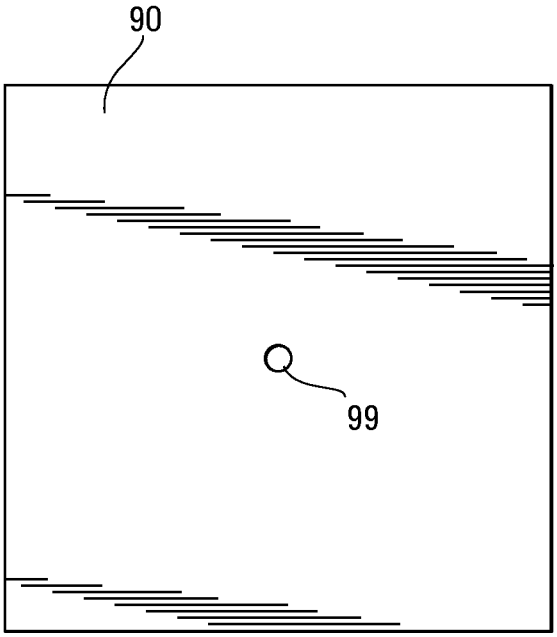
FIG. 13A is a plan view of one of the strike plates depicted in FIGS. 1A, 1B, 2A, 2B, 3A and 3B.
Figure 13B:
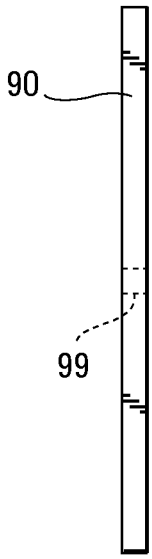
FIG. 13B is a side view of the strike plate depicted in FIG. 13A.
Figure 14:
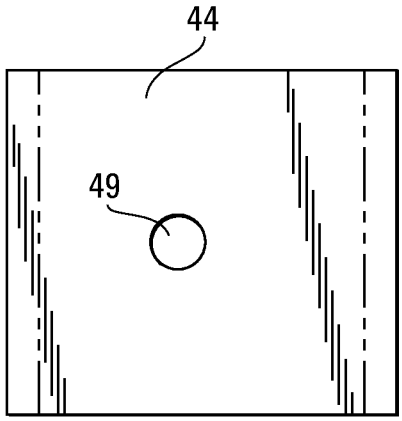
FIG. 14 is a plan view of a blank from which the guard angle standoff depicted in FIGS. 3A and 3B can be formed.
Figure 15A:
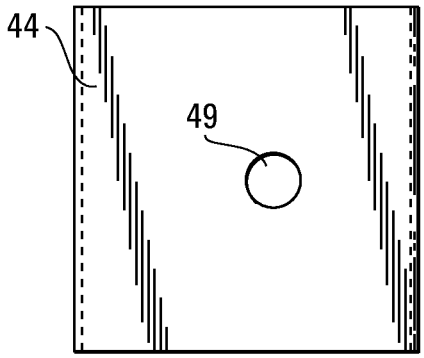
FIG. 15A is a plan view of the guard angle standoff depicted in FIGS. 3A and 3B.
Figure 15B:
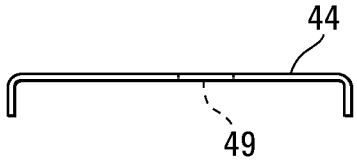
FIG. 15B is an end view of the guard angle standoff depicted in FIG. 15A.
Figure 16B:
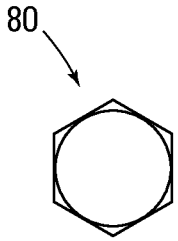
FIG. 16B is a plan view of the guard angle fastening bolt depicted in FIG. 16A.
Figure 16A:
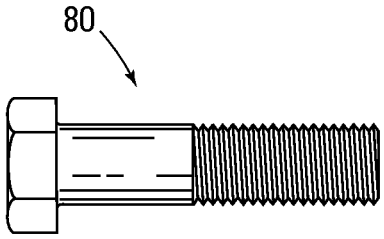
FIG. 16A is a side view of one of the guard angle fastening bolts depicted in FIGS. 3A and 3B.

Referring to FIGS. 7A and 7B, the leveling studs 30 each have proximal 30*p* and distal 30*d* ends, and are threaded along a significant length of the stud 30 for threadable engagement within a leveling orifice 28. Referring to FIGS. 1B, 2B and 3B, rotation of a leveling stud 30 within a leveling orifice 28 effects a change in the transverse z distance between the distal end 30*d* of the rotated leveling stud 30 and the leveling tie 20.

Figure 6A:
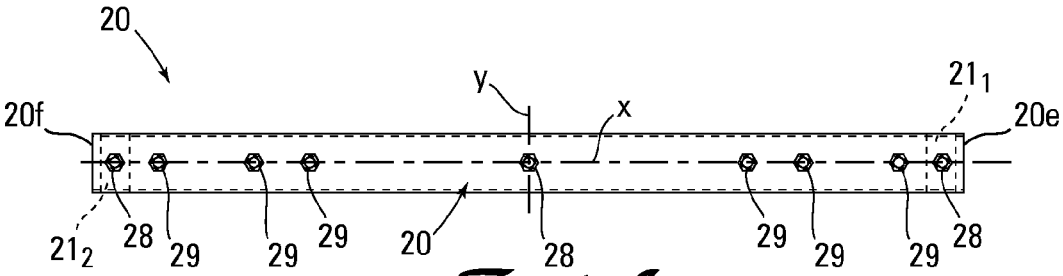
FIG. 6A is a plan view of the rail gauge leveling tie depicted in FIGS. 5A, 5B and 5C fitted with nuts on the underside of each orifice punched through the tie.
Figure 6B:
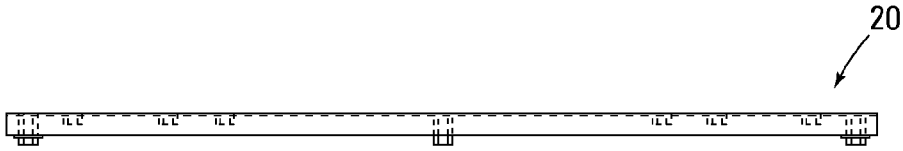
FIG. 6B is a side view of the rail gauge leveling tie depicted in FIG. 6A.
Figure 6C:
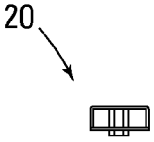
FIG. 6C is an end view of the rail gauge leveling tie depicted in FIG. 6A.
Figure 6D:
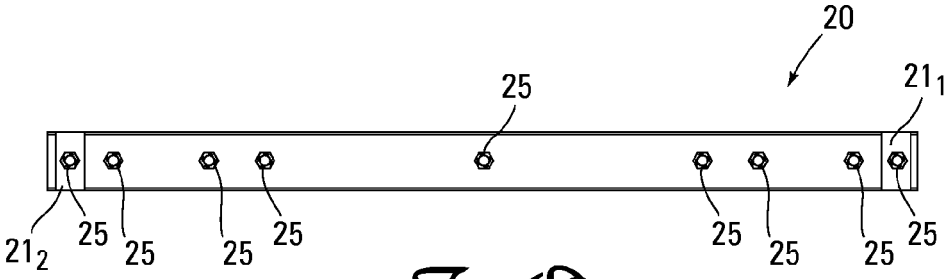
FIG. 6D is a bottom view of the rail gauge leveling tie depicted in FIG. 6A.

Referring to FIGS. 6A and 6D, a first stiffening plate $\mathbf{21}_1$ and a second stiffening plate $\mathbf{21}_2$ (collectively stiffening plates 21) may be attached (e.g., welded) to the underside 20*b* of the leveling tie 20 at each of the leveling orifices 28 proximate the ends 20e and 20f of the leveling tie 20, respectively, to provide additional structural strength to the leveling tie 20 at these support points.

Referring to FIGS. 1A, 1B, 2A, 2B, 3A, 3B, 13A and 13B, strike plates 90 may be employed for placement upon the ballast (not shown) at the bottom of an excavated railway bed into which the leveling tie 20 is to be supported, for providing a stable impenetrable surface upon which the distal end 30*d* of the leveling studs 30 may rest. The strike plates 90 are preferably designed with a centrally located dimple or small orifice 99 for capturing the distal end 30*d* of a vertical leveling stud 30 and thereby restricting horizontal movement of the captured distal end 30*d* of the leveling stud 30.

Referring to FIGS. 1A, 1B, 2A, 2B, 3A, 3B, 8A, 8B, 8C, 9A, 9B and 9C, the assembly preferably includes first and second electrically insulating riser plates 40 for electrically insulating the leveling tie 20 from the rails R carried on the leveling tie 20. Each riser plate 40 has a top surface 40*a*, a bottom surface 40*b*, a first side 40*c*, a second side 40*d* a first or outside end 40*e* and a second or inside end 40*f*. The riser plates 40 are preferably interchangeable for use on either end 20*e* or 20*f* of the leveling tie 20. Referring to FIGS. 1A, 1B, 8A, 8B and 8C, riser plates 41 designed to support a single rail $R_1$ have a pair of transversely z extending openings 49 each surrounded by a transversely z extending circumferential collar 43 projecting from the bottom 40*b* of the riser plate 41 The circumferential collars 43 are configured and arranged to fit snuggly within a corresponding pair of holes 29 through the central portion (unnumbered) of the leveling tie 20 proximate each end 20*e* and 20*f* of the leveling tie 20 for aligning the riser plate 40 upon the leveling tie 20 and allowing passage of a rail clip fastening bolt 70 through the openings 49 in the riser plate 40 and the holes 29 through the leveling tie 20. The fastening holes 29 through the leveling tie 20 are preferably positioned between the leveling orifices 28 proximate the ends 20*e* and 20*f* of the leveling tie 20.

Referring to FIGS. 2A, 2B, 9A, 9B and 9C, riser plates 42 designed to support either a single rail $R_1$ or a double rail $R_2$ have an additional transversely z extending opening 49 surrounded by a transversely z extending circumferential collar 43 projecting from the bottom 40*b* of the riser plate 42, configured and arranged to fit snuggly within a corresponding hole 29 through the central portion (unnumbered) of the leveling tie 20.

Figure 3A:
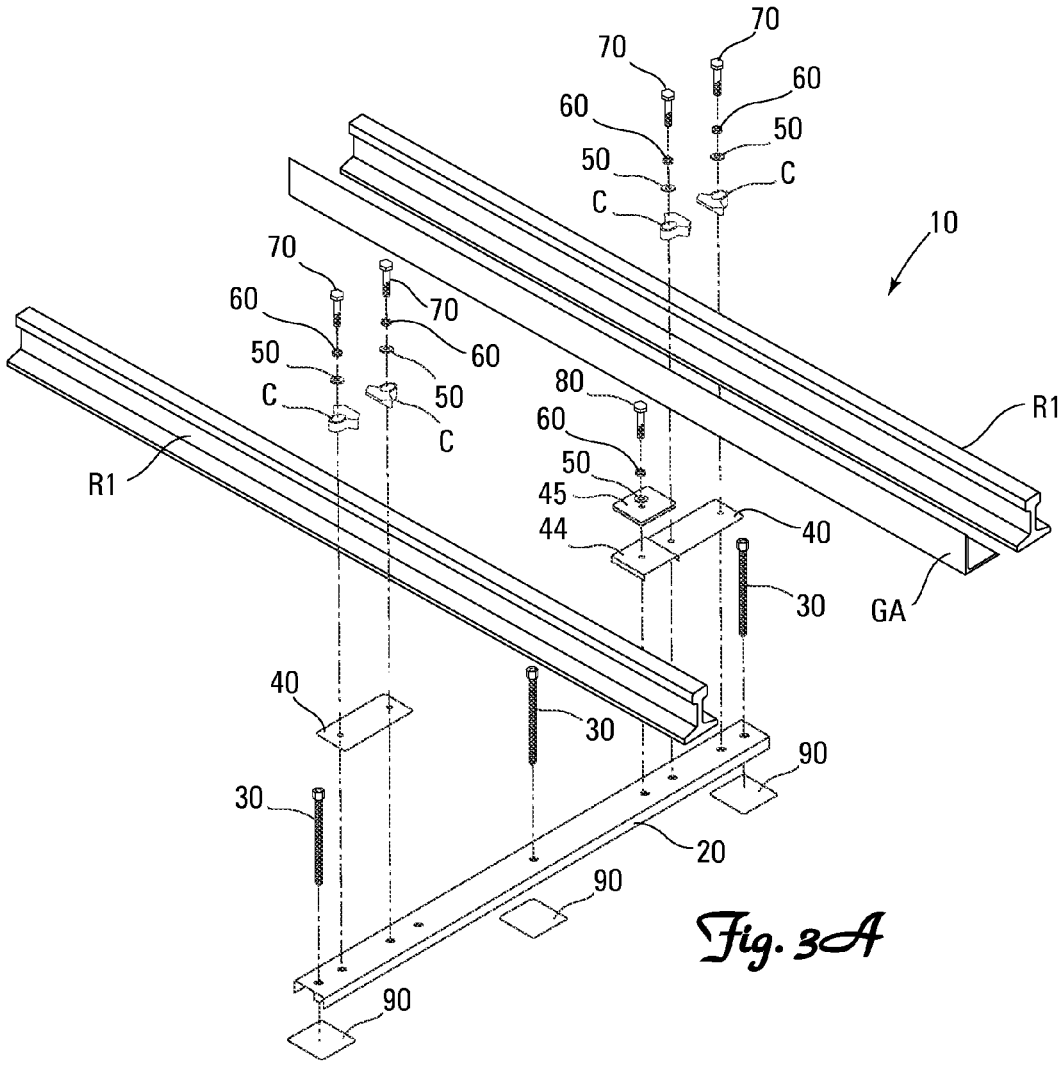
FIG. 3A is an exploded perspective view of a rail system employing one embodiment of the present invention configured to carry single rails and an emergency guard angle.
Figure 3B:
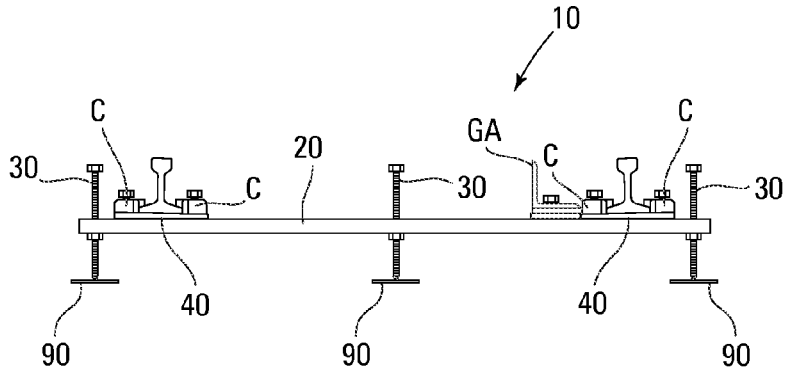
FIG. 3B is an assembled end view of the rail system depicted in FIG. 3A.

As shown in FIGS. 3A and 3B, the riser plates 42 designed to support either a single rail $R_1$ or a double rail $R_2$ may also be used to support a combination of a single rail $R_1$ and a guide angle GA. Referring to FIGS. 3A, 3B, 14, 15A and 15B, when a guide angle GA is employed it will typically be further supported upon a standoff 44 and an additional electrically insulating plate 45, and secured to the leveling tie 20 by a guard angle fastening bolt 80 passing through a fastening opening 49 in each.

Referring to FIGS. 8A, 8B, 8C, 9A, 9B and 9C, the riser plates 40 are preferably molded from a suitable plastic as a single solid unitary piece, with circumferential collars 43 projecting downward from each opening 49 in the riser plate 40 configured and arranged to snap fit into corresponding holes 29 in the rail gauge leveling tie 40 to provide quick and accurate alignment of the riser plate 40 onto the rail gauge leveling tie 20 during assembly. The riser plates 40 are preferably canted from outside end 40*e* to inside end 40*f*.

Figure 4:
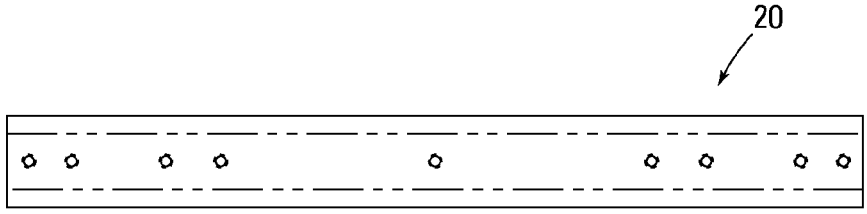
FIG. 4 is a plan view of a blank from which the rail gauge leveling tie depicted in FIGS. 1A, 1B, 2A, 2B, 3A and 3B can be formed.
Figure 5A:
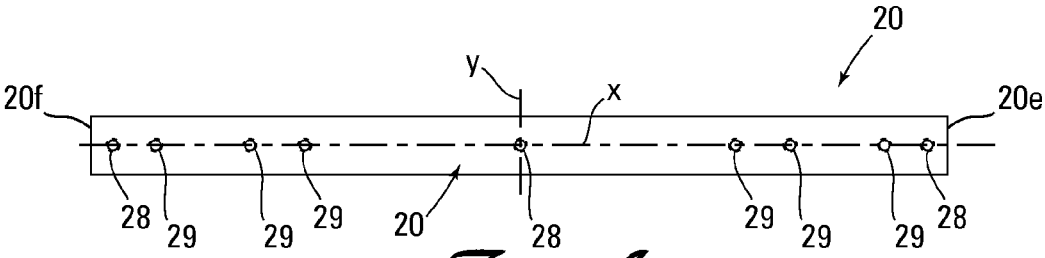
FIG. 5A is a plan view of the rail gauge leveling tie depicted in FIGS. 1A, 1B, 2A, 2B, 3A and 3B.
Figure 5B:
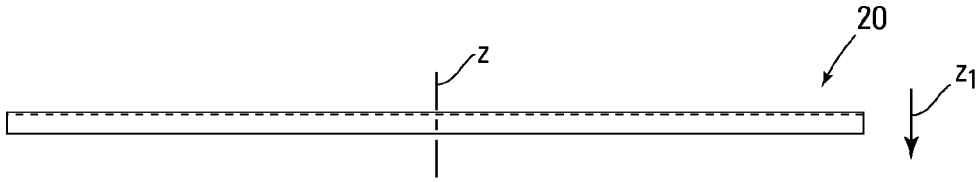
FIG. 5B is a side view of the rail gauge leveling tie depicted in FIG. 5A.
Figure 5C:
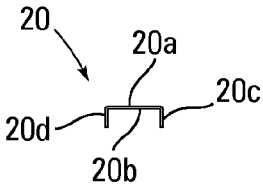
FIG. 5C is an end view of the rail gauge leveling tie depicted in FIG. 5A.

Referring to FIG. 4, the railway gauge leveling tie 20 may be formed by punching and bending suitable sheet metal stock. When formed in this manner, nuts 25 may be attached (e.g., welded) to the underside 20*b* of the leveling tie 20 in transverse z alignment with each leveling orifice 28 and each fastening hole 29 in order to provide appropriate threadable engagement between the leveling tie 20 and the leveling studs 30, rail clip fastening bolts 70 and guard angle fastening bolts 80.

All components must be constructed from material suitable for use in railway track. Electrical insulation of the rails R from the balance of the track can be achieved by employing electrically insulating rail clips C and riser plates 40. Suitable electrically insulating materials include specifically but not exclusively, high durometer rubber, nylon, glass reinforced plastics, wood, etc.

Suitable rail clips C are available from a number of suppliers, including L.B. Foster Company of Suwanee, Georgia. A suitable electrically insulating rail clip C is one constructed of glass reinforced nylon 66.

Use

Referring to FIGS. 1A, 1B, 2A, 2B, 3A and 3B, each railway gauge leveling tie 20 may be leveled relative to surrounding railway gauge leveling ties 20 and relative to itself by threading each of the leveling studs 30 an appropriate distance though the nut 25 attached to the underside of the railway gauge.

More specifically, the assembly 10 may be employed to prepare a railway bed (not shown) for the laying of railway track R by (i) obtaining an assembly 10, (ii) threading a first leveling stud 30 within a first leveling orifice 28 proximate one end 20*e* of the leveling tie 20, (iii) threading a second leveling stud 30 within a second leveling orifice 28 proximate the other end 20*f* of the leveling tie 20, and (iii) optionally threading a third leveling stud 30 within the central leveling orifice 28 intermediate the ends 20*e* and 20*f* of the leveling tie 20 to form a studded leveling tie, (iv) placing the studded leveling tie (not collectively numbered) within an excavated railway right of way (not shown) with the distal end 30*d* of the leveling studs 30 supported upon ballast (not shown) at the bottom of the excavated railway right of way (not shown), (v) rotating at least one of the threaded leveling studs 30 until the leveling tie 20 is at a desired vertical height and at a desired angle along the lateral y length of the leveling tie 20 to form a leveled leveling tie 20, and (vi) casting a castable material (not shown) (e.g., concerete) within the excavated railway right of way (not shown) to fixate the leveled leveling tie 20 within the railway right of way (not shown).

When strike plates 90 are employed, a strike plate 90 is placed over the ballast (not shown) underneath each leveling stud 30 so that the distal end 30*d* of each leveling stud 30 will be supported upon and captured by a strike plate 90.

Railway track may be constructed using the assembly 10 by (i) obtaining an assembly 10, (ii) threading a first leveling stud 30 within a first leveling orifice 28 proximate one end 20*e* of the leveling tie 20, (iii) threading a second leveling stud 30 within a second leveling orifice 28 proximate the other end 20*f* of the leveling tie 20, and (iii) optionally threading a third leveling stud 30 within the central leveling orifice 28 intermediate the ends 20*e* and 20*f* of the leveling tie 20 to form a studded leveling tie, (iv) placing the studded leveling tie (not collectively numbered) within an excavated railway right of way (not shown) with the distal end 30d of the leveling studs 30 supported upon ballast (not shown) at the bottom of the excavated railway right of way (not shown), (v) rotating at least one of the threaded leveling studs 30 until the leveling tie 20 is at a desired vertical height and at a desired angle along the lateral y length of the leveling tie 20 to form a leveled leveling tie 20, and (vi) casting a castable material (not shown) (e.g., concerete) within the excavated railway right of way (not shown) to fixate the leveled leveling tie 20 within the railway right of way (not shown), (vii) attaching a first rail R to the fixated leveling tie 20 atop a first electrically insulating riser plate 40 aligned upon the leveling tie 20 proximate the first end 20*e* of the leveling tie 20 with a first pair of rail clips C and associated hardware (round washer 50, lock washer 60 and fastening bolt 70), and (viii) attaching a second rail R to the fixated leveling tie 20 atop a second electrically insulating riser plate 40 aligned upon the leveling tie 20 proximate the second end 20*f* of the leveling tie 20 with a second pair of rail clips C and associated hardware (round washer 50, lock washer 60 and fastening bolt 70).

We claim:

1. An assembly, comprising:

(a) a longitudinally elongated rail gauge leveling tie operable for supporting a pair of rails at a defined longitudinal gauge, the tie having:

(i) a longitudinally elongated central portion defining longitudinally spaced first and second ends, laterally spaced first and second sides, and transversely spaced upper and lower surfaces with the lower surface spaced in a first transverse direction from the upper surface, (ii) a first flange extending in the first transverse direction from the first side of the central portion, (iii) a second flange extending in the first transverse direction from the second side of the central portion, (iv) a first transversely extending orifice through the central portion of the leveling tie proximate the first end of the leveling tie, and (v) a second transversely extending orifice through the central portion of the leveling tie proximate the second end of the leveling tie, (b) a first leveling stud having proximal and distal ends, the first leveling stud operable for threaded engagement within the first orifice whereby rotation of the first leveling stud within the first orifice effects a change in the transverse distance between the distal end of the first leveling stud and the central portion of the leveling tie, and (c) a second leveling stud having proximal and distal ends, the second leveling stud operable for threaded engaement within the second orifice whereby rotation of the second leveling stud within the second orifice effects a change in the transverse distance between the distal end of the second leveling stud and the central portion of the leveling tie.

2. The assembly of claim 1 further comprising:

(a) a first pair of longitudinally off set transversely extending holes through the central portion of the leveling tie proximate the first end of the leveling tie, (b) a second pair of longitudinally offset transversely extending holes through the central portion of the leveling tie proximate the second end of the leveling tie, (c) a first electrically insulating riser plate having a pair of transversely extending openings each surrounded by a transversely extending circumferential collar, the collars configured and arranged to snuggly fit within the first pair of holes for aligning the riser plate upon the leveling tie, and (d) a second electrically insulating riser plate havging a pair of transversely extending openings each surrounded by a transversely extending circumferential collar, the collars configured and arranged to snuggly fit within the second pair of holes for aligning the riser plate upon the leveling tie.

3. The assembly of claim 2 further comprising:

(a) a first pair of rail clips each configured and arranged for threadable engagement within one of the holes comprising the first pair of holes for securing the first riser plate and a first rail to the leveling tie with the first riser plate electrically insulating the first rail from the leveling tie, and (b) a second pair of rail clips each configured and arranged for threadable engagement within one of the holes comprising the second pair of holes for securing the second riser plate and a second rail to the leveling tie with the second riser plate electrically insulating the second rail from the leveling tie.

4. The assembly of claim 2 wherein the first and second pairs of holes are positioned between the first and second orifices.

5. The assembly of claim 2 wherein the first and second riser plates are interchangeable.

6. The assembly of claim 2 wherein the first and second riser plates are longitudinally canted.

7. The assembly of claim 1 further comprising:

(a) a first strike plate configured and arranged to rest upon a horizontal surface and capture the distal end of a vertically extending first leveling stud so as to restrict horizontal movement of a captured distal end of a vertically extending first leveling stud, and (b) a second strike plate configured and arranged to rest upon a horizontal surface and capture the distal end of a vertically extending second leveling stud so as to restrict horizontal movement of a captured distal end of a vertically extending second leveling stud.

8. The assembly of claim 1 wherein the central portion and first and second flanges are formed from a single unitary bent metal sheet.

9. The assembly of claim 8 wherein an internally threaded nut is fixedly attached to the lower surface of the central portion in transverse alignment with (-) each of the first and second transversely extending orifices, (-) each of the holes comprising the first pair of holes, and (-) each of the holes comprising the second pair of holes.

10. The assembly of claim 1 wherein the first and second flanges extend along the entire longitudinal length of the central portion of the leveling tie.

11. A method of preparing a railway bed for the laying of a railway track, comprising the steps of:

(a) obtaining an assembly in accordance with claim 1.

(b) threading the first leveling stud within the first orifice and threading the second leveling stud within the second orifice to form a studded leveling tie.

(c) placing the studded leveling tie within an excavated railway right of way with the distal end of the leveling studs supported upon ballast at the bottom of the excavated railway right of way, (d) rotating the threaded leveling studs until the leveling tie is at a desired vertical height and at a desired angle along the lateral length of the leveling tie to form a leveled leveling tie, and (e) casting a castable material within the excavated railway right of way to fixate the leveled leveling tie.

12. The method of claim 11 wherein the threaded leveling studs are rotated until the leveling tie is horizontally level along the lateral length of the leveling tie.

13. A method of preparing a railway bed for the layin of a railway track, comprising the steps of:

(a) obtaining an assembly in accordance with claim 7, (b) resting the first and second strike plates upon ballast in as excavated railway right of way, (c) threading the first leveling stud within the first orifice and threading the second leveling stud within the second orifice to form a studded leveling tie, (d) placing the studded leveling tie within the excavated railway right of way with the distal end of the first leveling stud supported upon and captured by the first strike plate and the distal end of the second leveling stud supported upon and captured by the second strike plate, (e) rotating the threaded leveling studs until the leveling tie is at a desired vertical hight and at a desired angle along the lateral length of the leveling tie to form a leveled leveling tie, and (f) casting a castable material the excavated railway right of way to fixate the leveled leveling tie.

14. The method of claim 13 wherein the threaded leveling studs are rotated until the leveling tie is horizontally level along the lateral length of the leveling tie.

15. A method of constructing railway track, comprising the steps of:

(a) obtaining an assembly in accordance with claim 3, (b) threading the first leveling stude within the first orifice and threading the second leveling stud within the second orifice to form a studded leveling tie, (c) placing the studded leveling tie within an excavated railway right of way with the distal end of the leveling studs supported upon ballast at the bottom of the excavated railway right of way, (d) rotating the threaded leveling studs until the leveling tie is at a desired vertical height and at a desired angle along the lateral length of the leveling tieto form a leveled leveling tie, (e) casting a castable material within the excavated railway right of way to fixate the leveled leveling tie, (f) attaching a first rail to the fixated leveling tie stop a first electrically insulating riser plate aligned upon the leveling tie with the first pair of rail clips, and (g) attaching a second rail to the fixated leveling tie atop a second electrically insulating riser plate aligned upon the leveling tie with the second pair of rail clips.

16. The method of claim 15 wherein the threaded leveling studs are rotated until the leveling tie is horizontally level along the lateral length of the leveling tie.

* * * * *